US007070321B2

(12) United States Patent
Gabus et al.

(10) Patent No.: US 7,070,321 B2
(45) Date of Patent: Jul. 4, 2006

(54) ANTITRIPPING DEVICE FOR WATCH-ESCAPEMENT

(75) Inventors: Raymond Gabus, Le Locle (CH); Thierry Conus, Lengnau (CH); Alain Zaugg, Le Brassus (CH); Andrés Cabezas Jurin, Yverdon-les-Bains (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/240,366

(22) Filed: Oct. 3, 2005

(65) Prior Publication Data

US 2006/0072376 A1 Apr. 6, 2006

(30) Foreign Application Priority Data

Oct. 5, 2004 (EP) ..... 04023667

(51) Int. Cl.
*G04B 15/00* (2006.01)
*G04B 17/04* (2006.01)

(52) U.S. Cl. ..... 368/127; 368/175

(58) Field of Classification Search ..... 368/124, 368/127, 161, 168, 175–178
See application file for complete search history.

(56) References Cited

U.S. PATENT DOCUMENTS 361,850 A 4/1887 Van Strait
3,934,403 A * 1/1976 Tilse ..... 368/175
3,943,701 A * 3/1976 Poix ..... 368/173
3,958,410 A * 5/1976 Bell ..... 368/175
5,907,524 A * 5/1999 Marmy et al. ..... 368/175
6,431,746 B1 * 8/2002 Jujo et al. ..... 368/127

FOREIGN PATENT DOCUMENTS

AT 225 624 1/1963
DE 1 206 811 12/1965

OTHER PUBLICATIONS

European Search Report issued in corresponding European Patent Application No. 04 02 3667 completed May 18, 2005.

* cited by examiner

*Primary Examiner*—Vit W. Miska
(74) *Attorney, Agent, or Firm*—Griffin & Szipl. P.C.

(57) ABSTRACT

The anti-trip device is for a detent escapement mounted on a wristwatch. It includes a finger fixed to the arm of the balance, two columns between which the finger can pass, said columns being secured to the balance bridge, and a locking arm fixed to the outer coil of the balance spring, said locking arm being able to be inserted between said columns and said finger to prevent the balance from rotating beyond an angle exceeding its normal operating angle. The locking arm is a clamp hooked onto the outer coil of the balance spring.

6 Claims, 3 Drawing Sheets

ANTITRIPPING DEVICE FOR WATCH-ESCAPEMENT

This application claims priority from European Patent Application No. 04023667.1 filed Oct. 5, 2004, the entire disclosure of which is incorporated herein by reference.

FIELD OF THE INVENTION

The present invention relates to an anti-trip device for a watch escapement, this escapement comprising, amongst other elements, a balance spring made up of several coils and a balance provided with at least one arm, the balance being pivotably mounted between a plate and a bridge, said device comprising a finger fixed to the balance arm, at least one column by which the finger can pass when the balance is moving, said column being secured to said balance bridge, and a locking arm fixed to the outer coil of the balance spring, the locking arm being able to insert itself between said column and said finger to prevent the sprung balance rotating beyond an angle outside its normal operating angle.

BACKGROUND OF THE INVENTION

Such a device is known. It was disclosed in the work entitled "Der Chronometer Gang" by Professor Alois Irk and published by Deutsche Uhrmacher Zeitung, Berlin 1923. Reference will be made particularly to paragraphs 116 to 120 (pages 74 to 77) and to FIG. 25 of the cited work.

This device is implemented in so called detent escapements which are suitable for timepieces of large dimensions such as marine chronometers. These timepieces are appreciated for their high level of precision, which is why they very often use a detent escapement, which itself famed for its high level of precision. This escapement has, however, a significant drawback, namely its sensitivity to shocks. Consequently, it is reputed to be unsuitable for wristwatches. In fact, a shock applied to the timepiece can cause its balance to rotate beyond a normal operating angle. This then produces tripping since unlocking and pulses occur twice in the same vibration.

When one wishes to fit a timepiece of small dimensions, for example a wristwatch, with a detent escapement to replace for example the conventional lever escapement and thus enable it to enjoy the advantages provided by such an escapement, new techniques will have to be used, different to those known to date if one wishes to avoid failure. Various solutions have been proposed recently to overcome the lack of energy developed by the sprung balance of a wristwatch to overcome the forces acting on the detent of a detent escapement. Nonetheless, the problem of tripping remains, and this has to be resolved when a balance spring of small dimensions, such as that mounted in a wristwatch, is used.

If one refers to the aforecited work, it can be seen that the locking arm proposed for the anti-trip device is suitable solely for a balance spring of large dimensions. It is in fact a part that has undergone machining several times including the machining of a bore through which the last coil of the balance spring will pass. This is ill suited to a balance spring of small dimensions, moreover it is difficult and complicated to make.

In order to overcome the aforecited drawbacks, the present invention, in addition to answering the generic definition of the first paragraph of this description, is characterized in that the locking arm is a clamp hooked onto the outer coil of the balance spring.

BRIEF DESCRIPTION OF THE DRAWINGS

The features and advantages of the present invention will appear from the following description, made with reference to the annexed drawings, and giving by way of explanatory but non-limiting example, an advantageous embodiment of an anti-trip device for a wristwatch fitted with a detent escapement, in said drawings.

DETAILED DESCRIPTION OF THE ILLUSTRATIVE EMBODIMENTS

Figure 1:
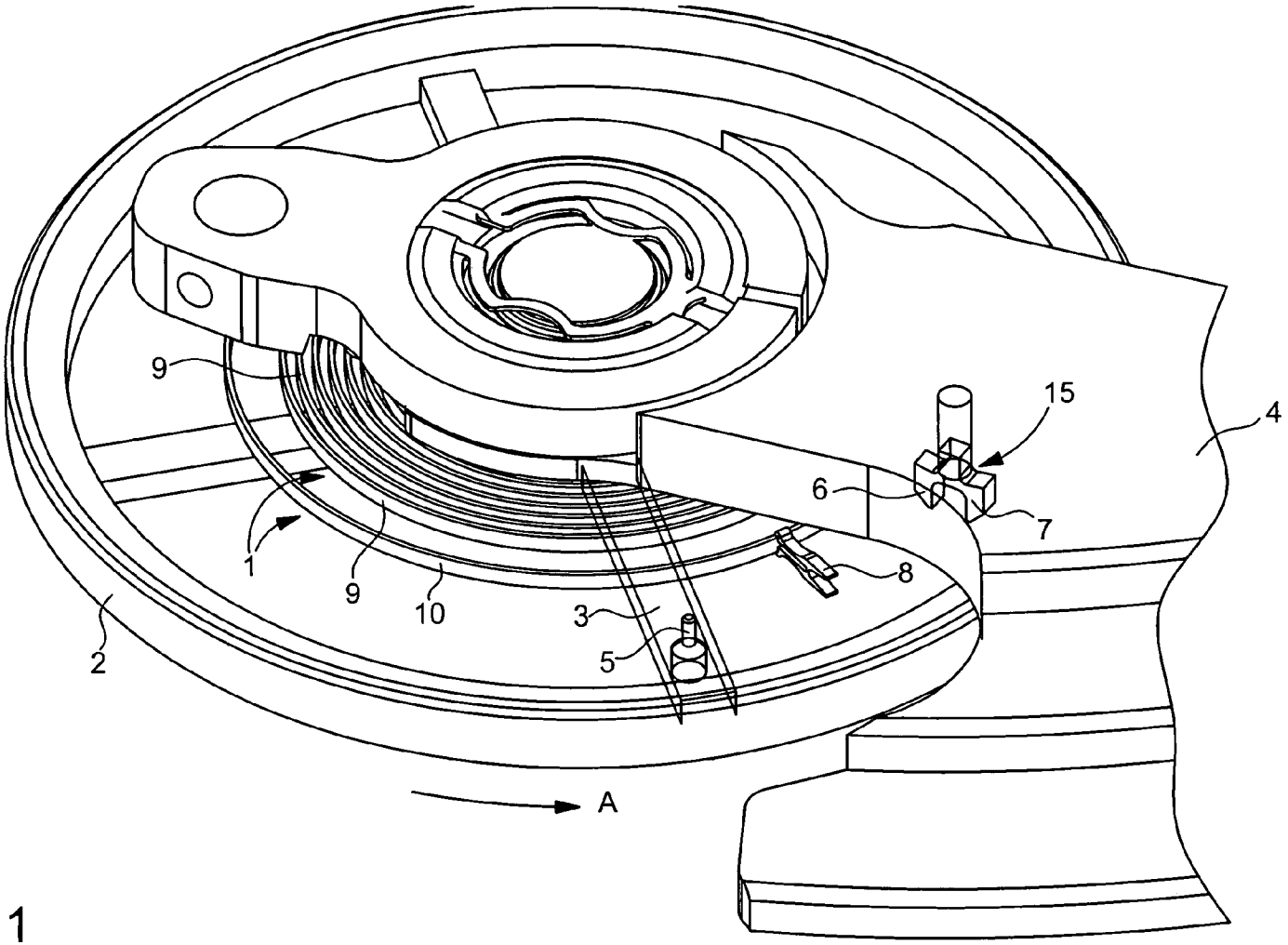
FIG. 1 is a perspective view of the anti-trip device showing the locking arm according to the invention.

The anti-trip device will now be described with reference to FIGS. 1 and 2. This device is for a timepiece escapement, more specifically a detent escapement, of which only those elements necessary for comprehension of the invention are shown in FIGS. 1 and 2, namely a balance spring 1 made up of several coils 9 and 10 and a balance 2 provided with at least one arm 3 and pivotably mounted between a plate (not shown) and a bridge 4.

The detent escapement further includes the following elements that are not shown in the drawings: an escapement wheel provided with generally pointed teeth which rest in turn on a locking pallet stone, a brake-lever returned by a spring, the brake-lever carrying said locking face of the pallet stone at its first end and, at its second end, a first actuating finger able to be actuated by a second actuating finger carried by a plate secured to the balance, this plate further carrying an impulse pallet stone able to receive impulses from the teeth of the escapement wheel. At each oscillation of the balance, the locking pallet stone is released from the tooth of the escapement wheel and another tooth of the same wheel, acting on the impulse pallet stone, gives an impulse to the balance. It will be observed that the second actuating finger is arranged so as only to actuate the first finger of the brake-lever in one rotational direction of the balance, i.e. during the first vibration of the oscillation after the impulse occurs. When the balance rotates in the other direction, i.e. during the second vibration of the oscillation, the first finger of the brake-lever is not actuated since the second finger carried by the plate is arranged to retract after which no impulses are produced. It is clear from the explanations that have just been given that if the first vibration makes the balance rotate beyond a normal amplitude which is of the order of 320 degrees, for example following a shock applied to the watch, the first finger of the brake-lever can be actuated a second time. A second impulse is then produced during the same vibration, which causes the escapement to trip.

Figure 2:
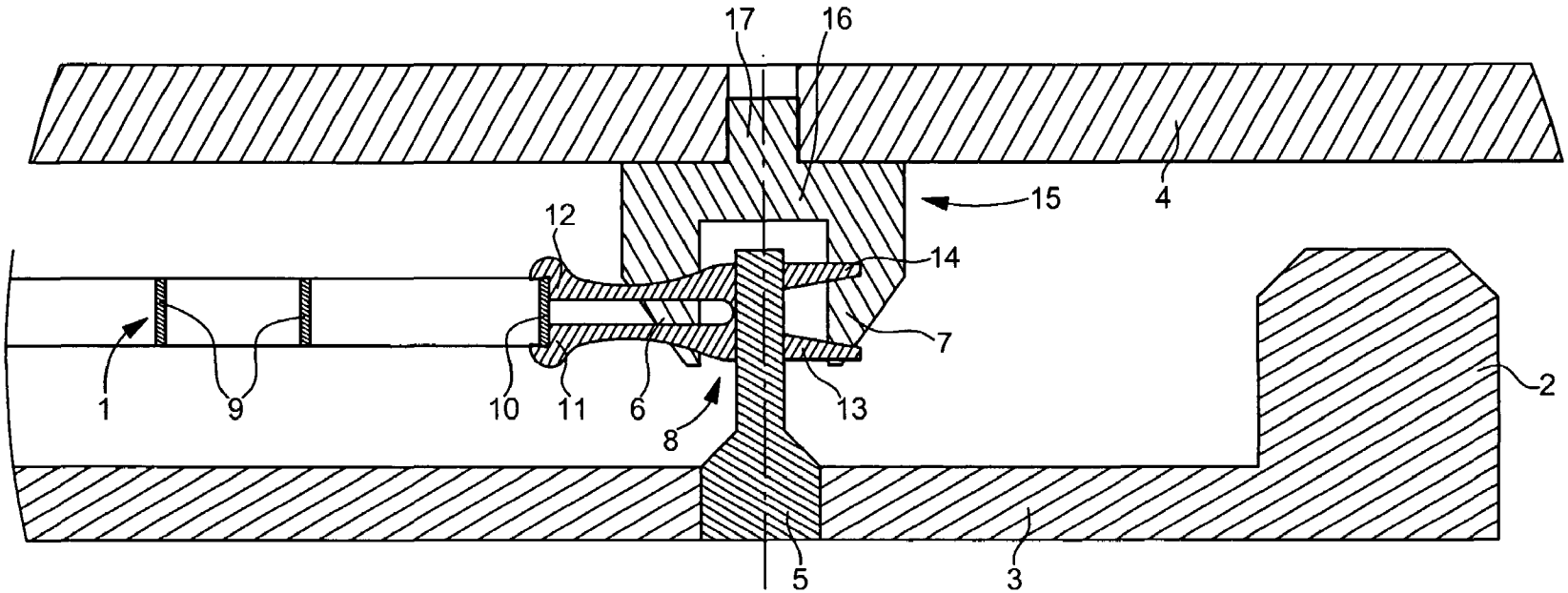
FIG. 2 is a profile view showing together the various elements involved in preventing the escapement from tripping.

In order to prevent this phenomenon, the anti-trip device proposed in the aforecited work and illustrated in FIGS. 1 and 2 of the present invention, comprises a finger 5 fixed to the arm of balance 2 and two columns 6 and 7 between which the finger can pass when the balance is moving, these columns being secured to bridge 4 of the balance. The device further includes a locking arm 8 fixed to the outer coil 10 of balance spring 1. As is shown particularly well in FIG. 2, this locking arm 8 is inserted between columns 6 and 7 and finger 5 to prevent balance 2 from rotating beyond an angle exceeding its normal rotational angle. In fact, at the end of the first vibration, a situation shown in FIG. 1, balance spring 1 and its last coil 10 are presenting their largest expanse which causes locking arm 8, fixed to the last coil, to be placed between finger 5 of arm 3 and the two columns 6 and 7 of bridge 4. At this moment, if a shock is applied to the timepiece and if this shock causes the balance to continue to rotate in the anti-clockwise direction (arrow A), finger 5 abuts against locking arm 8, the latter in turn abutting against columns 6 and 7 (a situation illustrated in FIG. 2). Balance 2 is then stopped preventing the second vibration discussed hereinbefore. Tripping is thus prevented. It will be noted that from this moment onwards, the balance will rotate in the opposite direction to make its second vibration. Balance spring 1 and the last coil 10 will be compressed again drawing locking arm 8 towards the centre. Locking arm 8 will then no longer be an obstacle to the passage of finger 5 between columns 6 and 7 which it will pass twice per oscillation.

Figure 3:
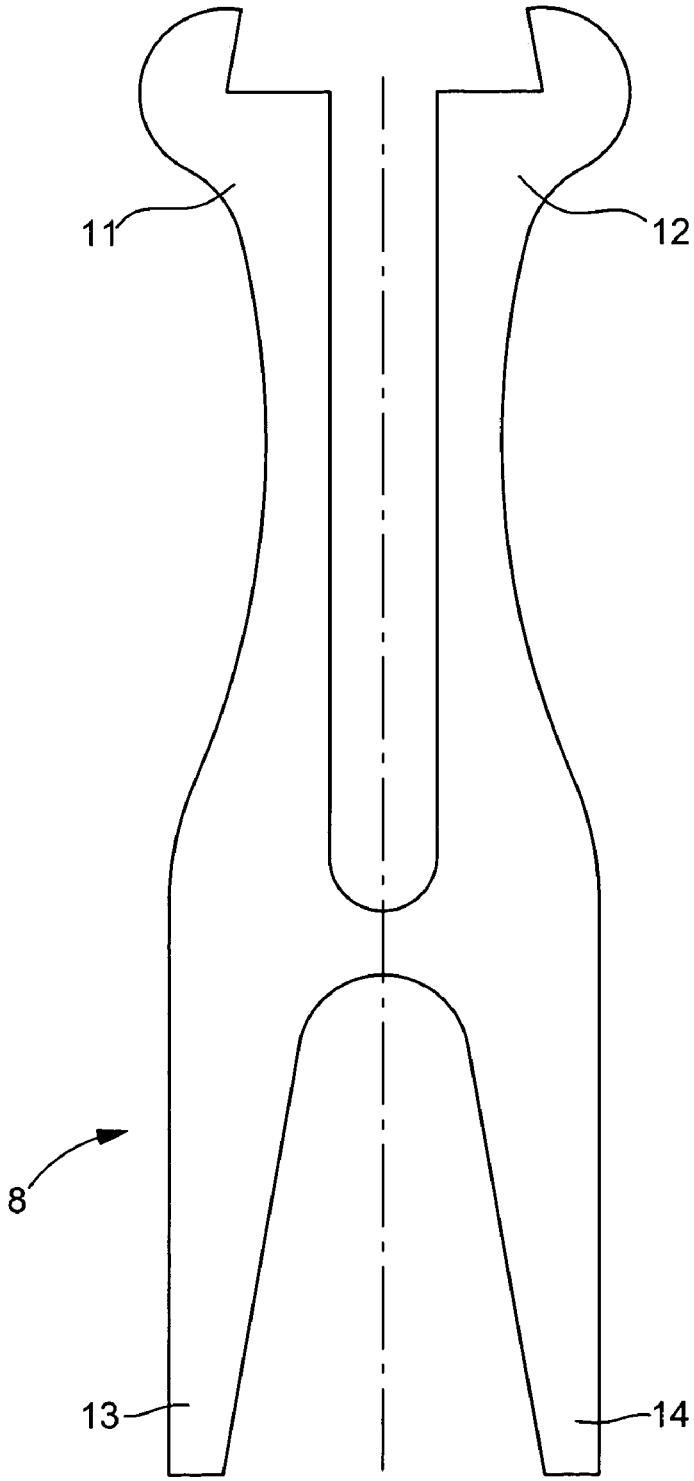
FIG. 3 is a plan view of the clamp used as locking arm according to the invention.

As FIGS. 1 to 3 show, the present invention is characterized in that the locking arm 8 is a clamp hooked onto the outer coil 10 of balance spring 1. This method is perfectly suited to the balance springs of small dimensions encountered, for example, in wristwatches. The system envisaged does not require any complicated preparation and machining of the locking arm as is the case of the arm of the aforecited work. The clamp can be arranged on the outer coil without any difficulty, at the desired location, without it being necessary to thread it onto the balance spring and fix it thereto as provided in the aforecited work.

Clamp 8 can take different forms, including that illustrated in FIGS. 2 and 3. Here, the clamp has the shape of an X whose top arms 11 and 12 are shaped to constrict the balance spring. FIG. 3 shows particularly well that the top arms are cut in the shape of bevelled jaws for gripping the balance spring properly. The bottom arms 13 and 14 are arranged to act as means for gripping and positioning the clamp. A specially designed tool for gripping and positioning the clamp enables the clamp to be gripped by its arms 13 and 14, allows said arms to be moved towards each other in order to move the top arms 11 and 12 apart elastically to fit them onto the balance spring. It will be understood that clamp 8 could be made from a strip simply by stamping or chemical etching.

It will be noted finally that the two columns 6 and 7 secured to bridge 4 could consist of two pins driven into the bridge. The present invention proposes, however, to simplify this passage by providing, as shown in FIGS. 1 and 2, a frame 15 whose two columns 6 and 7 are connected by a strut 16, this strut carrying a pin 17 driven into bridge 4 of balance 2.

It will also be noted that the device of the invention can be envisaged with one column fixed to bridge 4.

What is claimed is:

1. An anti-trip device for a timepiece escapement, said escapement including, amongst other elements, a balance spring made up of several coils and a balance provided with at least one arm, the balance being pivotably mounted between a plate and a bridge, said device including a finger fixed to the arm of the balance, at least one column by which the finger can pass when the balance is moving, said column being secured to the bridge of said balance, and a locking arm fixed to an outer coil of the balance spring, said locking arm being able to be inserted between said column and said finger to prevent the balance rotating beyond an angle exceeding its normal operating angle, wherein the locking arm is a clamp hooked onto the outer coil of the balance spring.

2. The anti-trip device according to claim 1, wherein said device further comprises a second column and in that said finger can pass between said first and second columns when the balance is moving.

3. The anti-trip device according to claim 1, wherein the clamp has the shape of an X, one end of whose top arms is shaped to constrict the balance spring elastically and those bottom arms are arranged to act as means for gripping and positioning said clamp.

4. The anti-trip device according to claim 3, wherein the clamp is a strip whose contours are obtained by chemical etching.

5. The anti-trip device according to claim 2, wherein the two columns secured to the balance bridge form a frame with a strut that connects them, said strut carrying a pin driven into the balance bridge.

6. The anti-trip device according to claim 2, wherein the clamp has the shape of an X, one end of whose top arms is shaped to constrict the balance spring elastically and those bottom arms are arranged to act as means for gripping and positioning said clamp.

* * * * *